United States Patent [19]

Matayoshi et al.

[11] Patent Number: 5,046,462

[45] Date of Patent: Sep. 10, 1991

[54] ROCKER ARM ARRANGEMENT FOR VARIABLE VALVE TIMING TYPE INTERNAL COMBUSTION ENGINE VALVE TRAIN

[75] Inventors: Yutaka Matayoshi, Yokosuka; Makoto Nakamura, Yokohama; Shigeru Sakuragi; Shigeo Muranaka, both of Yokosuka, all of Japan

[73] Assignee: Nissan Motor Co., Ltd., Japan

[21] Appl. No.: 593,202

[22] Filed: Oct. 5, 1990

[30] Foreign Application Priority Data

Oct. 12, 1989 [JP] Japan ..... 1-265911

[51] Int. Cl.[5] ..... F01L 1/34

[52] U.S. Cl. ..... 123/90.16; 123/90.39

[58] Field of Search ..... 123/90.15, 90.16, 90.39, 123/90.4, 90.41, 90.44, 90.45, 90.47

[56] References Cited

U.S. PATENT DOCUMENTS

| | | | |
|---|---|---|---|
| 4,151,817 | 5/1979 | Mueller | 123/90.16 |
| 4,768,467 | 9/1988 | Yamada et al. | 123/90.16 |
| 4,768,475 | 9/1988 | Ikemura | 123/90.16 |
| 4,844,023 | 7/1989 | Konno et al. | 123/90.16 |
| 4,901,685 | 2/1990 | Fukuo et al. | 123/90.16 |

FOREIGN PATENT DOCUMENTS

| | | | |
|---|---|---|---|
| 0276533 | 8/1988 | European Pat. Off. . | |
| 63-45521 | 11/1982 | Japan . | |
| 0168206 | 9/1984 | Japan | 123/90.16 |
| 63-57805 | 3/1988 | Japan . | |
| 63-167016 | 7/1988 | Japan . | |
| 2185784 | 7/1987 | United Kingdom . | |
| 2199894 | 6/1988 | United Kingdom . | |

*Primary Examiner*—David A. Okonsky
*Assistant Examiner*—Weilun Lo
*Attorney, Agent, or Firm*—Lowe, Price, LeBlanc & Becker

[57] ABSTRACT

A rocker arm is pivotally mounted on a rocker shaft. A first cam follower such as a roller is provided on the rocker arm and arranged to cooperate with a low speed cam. A second cam follower is reciprocally mounted on the rocker arm and arranged to cooperate with a high speed cam. A locking arrangement for selective locking the second cam follower in place comprises three plungers which are each reciprocatively received in their own bore. One of the bores is formed in the second cam follower while the other two are formed in the rocker arm. When hydraulic pressure is applied to one end of one of the plungers and the high and low speed cam followers are in engagement with the base circles of the respective high and low speed cams, the plungers are axialy displaced against a return spring in a manner two project into an adjacent bore and induce interlocking.

11 Claims, 7 Drawing Sheets

ROCKER ARM ARRANGEMENT FOR VARIABLE VALVE TIMING TYPE INTERNAL COMBUSTION ENGINE VALVE TRAIN

BACKGROUND OF THE INVENTION

1. Field of the Invention

The present invention relates generally to a variable valve timing arrangement for an internal combustion engine and more specifically to a rocker arm construction for such an arrangement.

2. Description of the Prior Art

JU-A-63-45521 discloses the prior art arrangement shown in FIG. 14. In this arrangement a single inlet valve 101 is operatively connected with low speed/high speed dual cam arrangement by way of a rocker arm wherein said second cam follower moves with respect to said rocker arm solely in translation 104. The rocker arm 104 in this instance is of the center pivot type and includes a low speed cam follower not shown and a high speed cam follower 105. The high speed cam follower 105 is formed on the end of a cylindrical member which is reciprocatively disposed in bore formed proximate one end of the rocker arm. A spring which is disposed in the bore biases the speed cam follower 105 into engagement with the high speed cam 103.

A rotatable stopper 106 which is arranged in the bore is connected with an hydraulically operated actuator 107. In a first rotational position the stopper 106 permits the reciprocation of the cylindrical member within the bore, while in a second rotational position reciprocation is prevented.

The supply of hydraulic fluid to the actuator is determined by a microprocessor 109 which controls a switching valve 110. The valve 110 selectively supplies the output of a pump 111 via a passage structure which is formed in both the rocker shaft on which the rocker arm is pivotably mounted and the rocker arm per se.

When the actuator 107 is supplied with hydraulic fluid from the pump 111, a link 112 rotates the stopper to a position in which the locks the cam follower 105 in position and thus enables the high speed cam 103 to actuate the rocker arm.

However, this arrangement suffers from the drawback that it requires a larger number of moving parts and has a relatively large mass and resulting moment. It therefore exhibits deteriorated cam following characteristics. In addition to this, the actuator—link—stopper arrangement is relatively cumbersome and slow acting and the amount of time available during high speed engine operation, for the actuator 107 to rotate the stopper 106 to a position wherein relative movement between the rocker arm 104 and the cam follower 105 is prevented, is often insufficient for the stopper to be properly positioned.

JP-A-63-167016 and JP-A-63-57805 disclosed rocker arm arrangements which include a first rocker arm which cooperates with a low speed cam and a second rocker arm which cooperates with a high speed cam. The two rocker arms pivotally mounted on a common rocker arm shaft.

A hydraulically operated connection device which enables the first and second rocker arms to be selectively locked together, comprises a set of plunger bores which are formed in the rocker arms in a manner to be parallel with and at a predetermined distance from, the axis of the shaft about which the arms are commonly pivotal. By applying a hydraulic pressure to the end or ends of the plungers reciprocally disposed in the bores, the plungers can be induced to move axially along their bores and induce the situation wherein two of the plungers will partially enter an adjacent bore and lock the two arms together.

However, this arrangement has suffered from the drawbacks that as the rocker arms are pivotally mounted on a rocker arm shaft, minor variations in the rocker arm dimensions lead to variations in the opening and closing timing of the engine valves and in that the rocker arms become relatively large and exhibit large moments.

In addition to this, seats for the lost motion springs which are operatively connected with the high speed rocker arms must be provided on the cylinder head. This of course increases the complexity of forming and arranging the upper surface of the cylinder head.

SUMMARY OF THE INVENTION

It is an object of the present invention to provide a rocker arm arrangement which exhibits rapid response to control signal applied thereto, which is compact and which does not require special spring mounting sites to be provided on the cylinder head.

In brief, the above objects are achieved by an arrangement wherein a rocker arm is pivotally mounted on a rocker shaft. A first cam follower such as a roller is provided on the rocker arm and arranged to cooperate with a low speed cam. A second cam follower is reciprocally mounted on the rocker arm and arranged to cooperate with a high speed cam. A locking arrangement for selective locking the second cam follower in place comprises three plungers which are each reciprocatively received in their own bore. One of the bores is formed in the second cam follower while the other two are formed in the rocker arm. When hydraulic pressure is applied to one end of one of the plungers and the high and low speed cam followers are in engagement with the base circles of the respective high and low speed cams, the plungers are axially displaced against a return spring in a manner two project into an adjacent bore and induce interlocking.

More specifically, a first aspect of the present invention comes in a valve train for an internal combustion engine having a cylinder head, a poppet valve which is associated with said cylinder head and a rocker shaft which is supported on said cylinder head, and which features: a rocker arm, said first rocker arm being pivotally mounted on the rocker shaft, said rocker arm having a portion adapted to engage said poppet valve; a first cam follower supported on said rocker arm, said first cam follower being arranged to engage a first cam provided on a cam shaft; a second cam follower which is reciprocatively mounted on said rocker arm, said second cam follower comprising: resilient means for biasing said second cam follower into contact with a second cam provided on the cam shaft; means defining a first bore in said second cam follower in which a first plunger is reciprocatively disposed; means defining a second bore in said rocker arm, said second bore being arranged to align with said first bore under a predetermined rocker arm operation; and hydraulically controlled means for causing said plunger to slide axially in said first bore and for causing a portion of said plunger to project into said second bore.

DETAILED DESCRIPTION OF THE PREFERRED EMBODIMENTS

Figure 1:
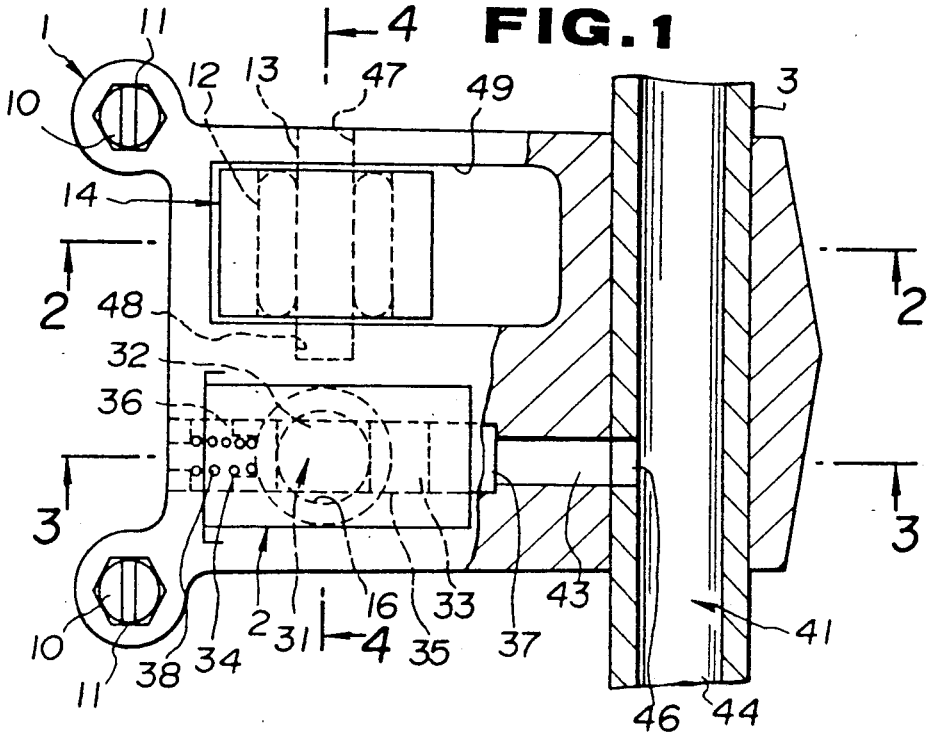
FIG. 1 is a plan view of a rocker arm arrangement according to a first embodiment of the present invention.
Figure 2:
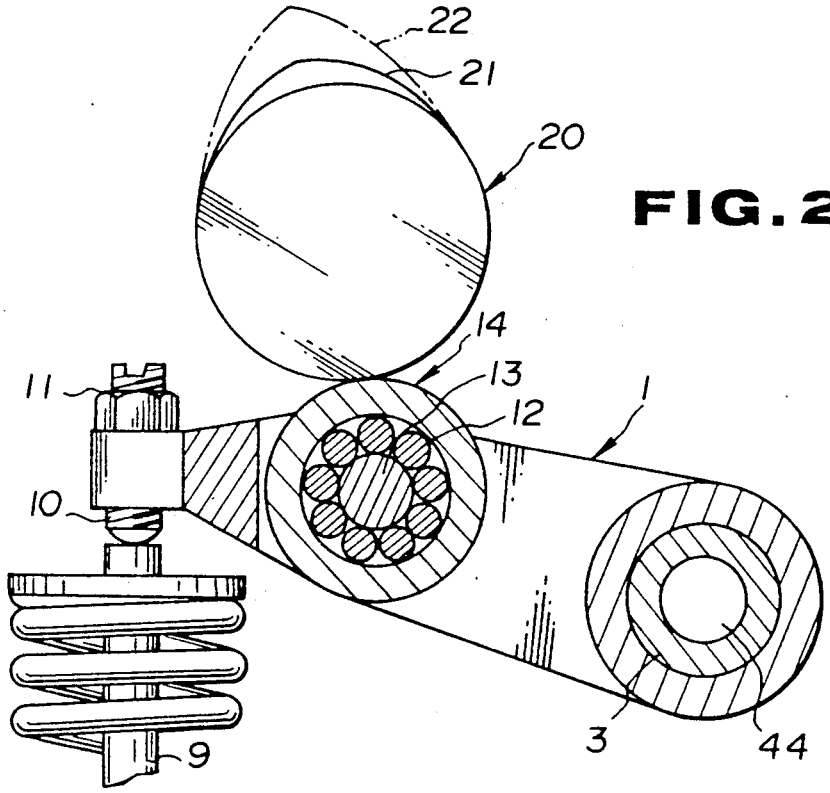
FIG. 2 is a side sectional view as taken along line 2—2 of FIG. 1.

FIGS. 1 to 4 show a first embodiment of the present invention. This embodiment takes the form of a rocker arm 1 which is arranged to synchronously open and close two poppet valve 9. These valves 9 may be either inlet or exhaust valves.

The rocker arm 1 is arranged so that one end thereof engages both of the valves 9 while the other is pivotally supported on the cylinder head by way of main rocker shaft 3. The ends of the rocker arm which engages the valves 9 are provided with adjust screws 10 and locknuts 11. A roller 14 is disposed in an opening 49 formed in the rocker arm 1 and rotatably mounted thereon by way of a shaft 13 and needle bearings 12. This roller 14 is arranged to act as a follower which engages a low speed cam 21 (viz., a cam which is configured for low speed engine operation).

The shaft 13 on which the roller 14 is supported is force fitted into bore 47, 48 formed in the rocker arm 1.

A second essentially T shaped mushroom-like high speed cam follower 2 arrangement is disposed directly below the cam shaft 20 and adjacent the roller 14 (low speed cam follower). This follower arrangement includes a cam follower member 23 which has curved upper surface 24 which is arranged to engage a high speed cam 22, and an integral cylindrical shaft-like portion 25. The cylindrical shaft-like portion 25 is reciprocatively received in a cylindrical bore 16 formed in the rocker arm 1. In this instance the center line "d" of the bore 16 is arranged such that when the roller 14 is in engagement with the base circle of the low speed cam 21 (viz., the rocker arm is not be induced to pivot), it intersects the axis of rotation "e" of the cam shaft 20.

The rocker arm 1 is formed with a guide surface 17 which engages an edge of the rectangular shaped cam follower member 23 and prevents the same from rotating about the axis of the cylindrical shaft-like portion 25.

A lost motion spring 15 is disposed between a shoulder 18 defined near the upper end of the bore 16 and the lower surface of the cam follower member 23. As shown, this spring takes the form of a coil compression spring which is disposed about the shaft-like portion 25 and arranged to bias the cam follower portion into engagement with the high speed cam 22.

The lower end of the shaft-like portion 25 has a pin 19 (split pin or the like) disposed therethrough to limit the movement of the shaft 25 (as it will be referred to hereinafter) in the direction of the cam shaft 20 and to prevent the shaft from being removed from the bore 16.

An interlocking device for locking the cam follower arrangement 2 in position and preventing the same from reciprocating in the bore 16, comprises a radial bore 32 which is formed in in the shaft 25 and a plunger 31 which is reciprocatively received in the bore 32. The arrangement further includes coaxially aligned bores 35, 36 are formed in the body of the rocker arm 1 in which plungers 33, 34 are reciprocatively disposed.

The inboard end of the plunger 33 is exposed to a control chamber 37, while the inboard end of the plunger 34 abuts a return spring 38. A small diameter bore 40 vents the spring chamber defined in the bore 36 by the plunger 34.

The ends of the central plunger 31 are domed while the plungers 33 and 34 have flat ends. The plungers 31, 33 and 34 are dimensioned so that in the absence of a pressure in the control chamber 37 of a magnitude which overcomes the bias of the return spring 38, the plungers assume positions in which the shaft 25 is free to reciprocate in the bore 16.

Figure 3:
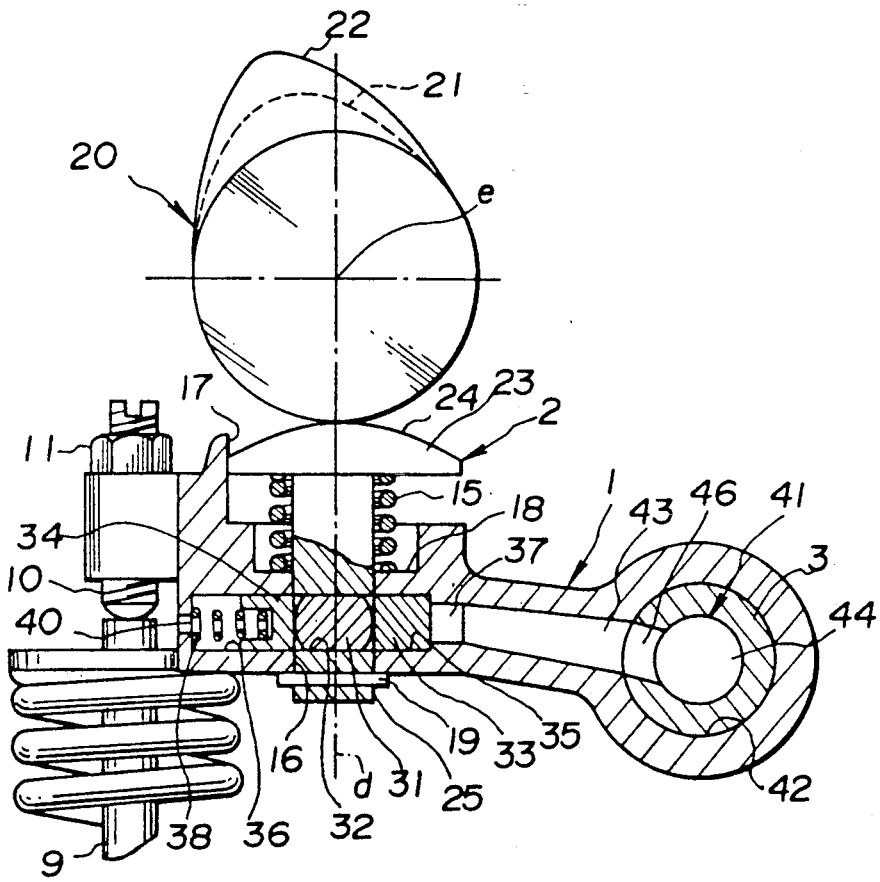
FIG. 3 is a side sectional view as taken along line 3—3 of FIG. 1.
Figure 4:
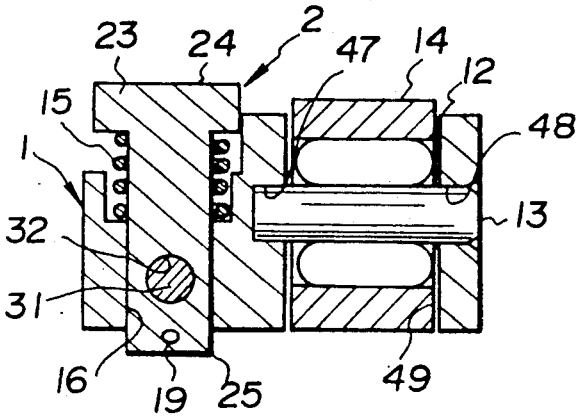
FIG. 4 is a sectional view as taken along section line 4—4 of FIG. 1.

The bores 32, 35 and 36 are arranged so as to align when the both of the low and high speed cam followers 14, 23 respectively engage the base circles of the low and high speed cams 21, 22, in the manner illustrated in FIG. 3.

A passage structure 41 via which a hydraulic control pressure is supplied to the control chamber 37 consists of a passage which leads from the control chamber 37 to a bore 42, in which the rocker shaft 3 is received, an oil gallery 44 which extends coaxially along the rocker shaft 3, and a radial bore 46 which provides fluid communication between the oil gallery 44 and the passage 43.

The oil gallery 44 communicates with a non-illustrated source of hydraulic fluid under pressure. This source comprises a switching valve (not shown) which is fluidly interposed between the chamber 37 and an oil pump. The valve is controlled by a control unit which receives data inputs indicative of engine speed, coolant temperature, lubricant oil temperature, supercharge pressure, engine throttle valve position. This control unit determines when it is necessary to switch between high and low cam lifting.

The low and high speed cams 21, 22 are both formed integrally on a cam shaft and have profiles which are designed to produce the appropriate amount of lift and timing for low and high engine speed operation, respectively. Viz., the amount of lift and/or the length of time the valve is opened by the high speed cam 22 is greater than that induced the low speed one.

OPERATION

The operation of the above described embodiment is such that during low speed modes of engine operation the pressure which supplied into the control chamber 37 is either drained or reduced to level which cannot overcome the bias of the return spring 38 the permits the plungers to assume the positions shown in FIG. 3. Viz., positions wherein the shaft 25 is free to reciprocate in the bore 16 against the bias of the lost motion spring 15. The shaft 25 is arranged so that until the lift profile of the low speed cam 21 begins to engage the roller 14, the axis thereof intersects the axis of rotation of the cam shaft 20. Under these conditions the shaft 25 is induced to smoothly slide down through the bore 16 as the high speed cam lift profile engages the curved upper surface 24 of the cam follower member 23. The clearance between the lower surface of the cam follower member 23 and upper surface of the rocker arm 1 is greater than the difference in the maximum lifts produced by the high and low speed cams 22, 21. This prevents directly contact between the lower surface of the cam follower member 23 and the top of the rocker arm 1 during low speed modes and thus reduces the amount of noise produced by the valve train.

When the engine shifts into a high speed mode of operation and/or operating conditions demand that the valves 9 be lifted by the high speed cam 22, pressure is supplied via the oil gallery and passage 43 to the control chamber 37. This produces a bias which, when the cam followers 14 and 23 are in engagement with the base circles of the low and high speed cams 21, 22, overcomes the return spring and moves the plungers 35, 31 and 34 in a manner wherein the plungers 33 and 31 move axially and each project partially into bores 32 and 36, respectively.

This of course locks the shaft 25 in the bore and prevents the same from moving relative to the rocker arm 1. Under these conditions, the rocker arm 1 is pivoted under the influence of the high speed cam 22 rather than the low speed one 21, and the amount of lift and/or timing of the valves 9 are determined by the profile of the high speed cam.

Upon the engine operation returning to a low speed mode, the pressure prevailing in the control chamber 37 is reduced and the return spring 38 is permitted to urge the three axially aligned plungers 33, 31 and 34 back to the positions shown in FIG. 3 when the cam followers 14, 23 are both in engagement with the base circles Of the cams 21, 22. Under these condition the amount of pivoting of the rocker arm is determined by the engagement between the low speed cam 21 and the low speed cam follower (roller). Viz., the high speed cam follower arrangement is merely induced to reciprocate back and forth within the bore 16.

With this arrangement it is possible to maintain the torque output of the engine at high levels during both low and high speed modes of engine operation.

As the three plungers 31, 33 & 34 are in abutment with one another upon the pressure in control chamber being increased to a level which overcomes the bias of the return spring 38 and the three bores coming into alignment, the plungers are able to move very quickly into their respective locking positions. Accordingly, the above described arrangement features good response characteristics particularly when compared with the first prior art arrangement discussed in the opening paragraphs of the instant disclosure.

Further, the rocker arm arrangement according to the first embodiment is simple and compact. That is to say, it makes use of the space between the rocker shaft 3 and the valves 9 to arrange the three plungers and control chamber 37 and to dispose the reciprocating high speed cam follower 2 and lost motion spring 15. As the high speed cam follower arrangement is relatively small, the lost motion spring 15 can be relatively weak and thus reduce the amount of friction which is produced between the high speed cam and the cam follower member 23, during low engine speed modes of operation.

Even though the high speed cam follower arrangement adds unnecessarily to the mass of the rocker arm 1 during low engine speed modes of engine operation, as the speed at which the valves 9 are opened and closed is relatively low, there are no loss in valve following characteristics.

Further, it is possible to assembly the rocker arm according to the first embodiment into a unit which can be then mounted on the rocker shaft 3. The precision with which the roller 14 and follower 23 are arranged on the respective rocker arms can be checked and/or adjusted before the unit is actually mounted on the cylinder head. This reduces the amount of work which must be done in order to ensure uniform lift characteristics from cylinder to cylinder. That is to say, with the above mentioned second and third prior art arrangement, these factors cannot be checked until both rocker arms are mounted on the cylinder head. In addition, the fact that the lost motion spring 25 does not require a seat to be formed on the cylinder head per se, simplifies the cylinder head per se and reduces the amount of variation during assembly.

SECOND EMBODIMENT

Figure 5:
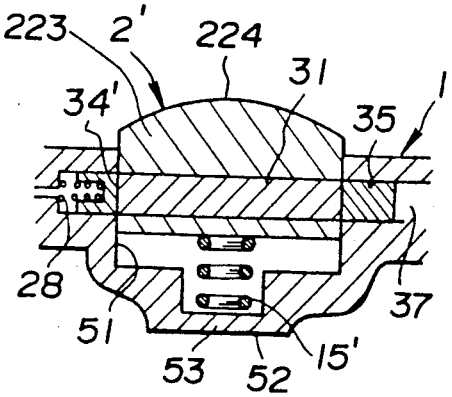
FIG. 5 is a sectional view showing a second embodiment of the present invention.
Figure 6:
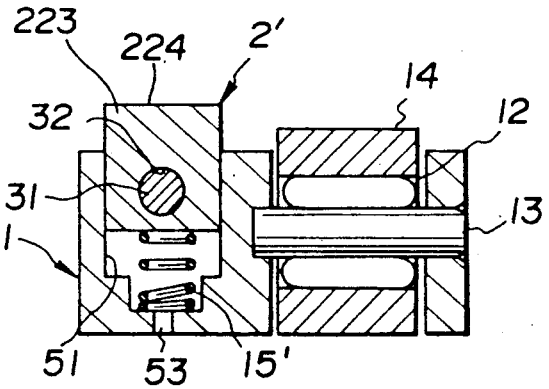
FIG. 6 is a sectional view of the second embodiment as it would appear when taken along a section line which corresponds to section line 4—4 of FIG. 1.

FIGS. 5 and 6 show a second embodiment of the present invention. In this embodiment, the high speed cam follower arrangement 2' comprises a rectangular cross-section recess 51 in which a rectangular block shaped piston-like member 223 is reciprocatively disposed. The upper surface of the block shaped member 223 is formed with a curved cam following surface 224. The bottom of the recess 51 is stepped in a manner to receive the lower end of a lost motion spring 15'. The member 223 is formed with a bore in which a plunger 31 is reciprocatively disposed. The ends of this plunger are flat and the plunger is dimensioned so that the ends thereof can lie flush with the side walls of the member 223. Plungers 4', 35' are reciprocatively disposed in coaxially aligned bores. The outboard ends of these plungers are also flat.

The operation of this embodiment is the same as the first one.

THIRD EMBODIMENT

Figure 7:
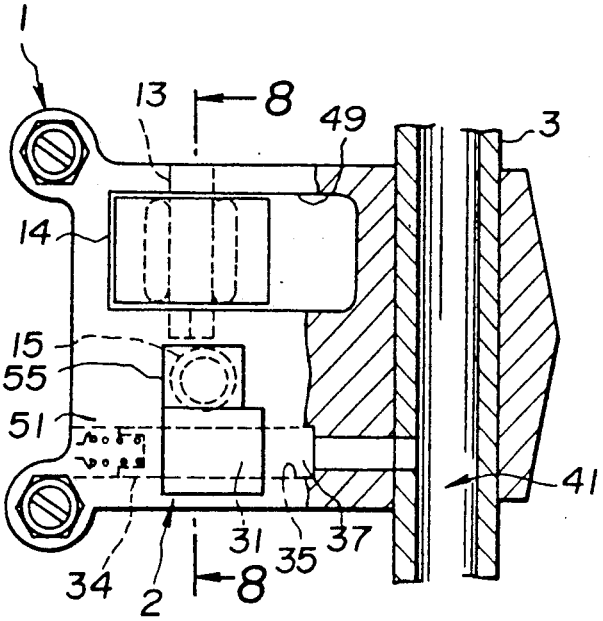
FIG. 7 is a plan view showing a third embodiment of the present invention.
Figure 8:
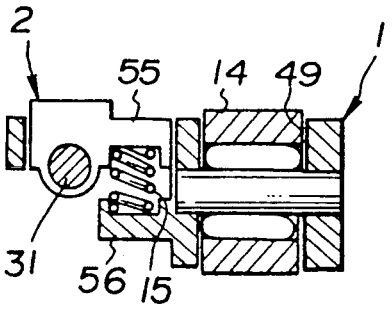
FIG. 8 is a sectional view as taken along section line 8—8 of FIG. 7.
Figure 8A:
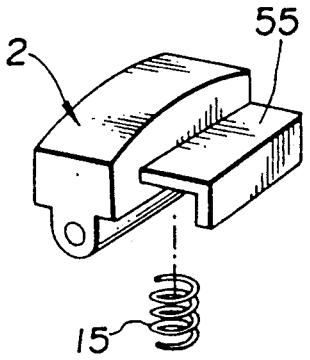
FIG. 8A is a perspective view showing the configuration of the cam follower used in the third embodiment.

FIGS. 7 and 8 show a third embodiment of the present invention. This embodiment is basically similar to the former two and differs in the location of the lost motion spring 15 and the surface which actually engages the high speed cam to be positionally offset with respect to one another. The high speed cam follower is configured in the manner shown in FIG. 8A. This allows for a saving in space and for a reduction in the size of the reciprocating member on which the high speed cam follower surface is formed.

FOURTH EMBODIMENT

Figure 9:
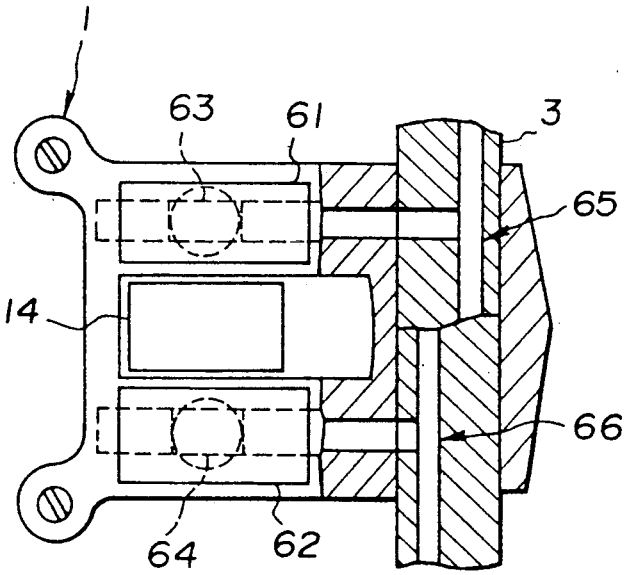
FIG. 9 is a plan view, partially in section, which shows a fourth embodiment of the present invention.

FIG. 9 shows a fourth embodiment of the present invention. In this arrangement the roller 14 is arranged in the center of the rocker arm and two high speed cam follower arrangements 61, 62 disposed in bores located on either side of the roller. In this embodiment the cam follower arrangements exhibit constructions which are essentially the same as that shown in FIG. 5. The two control chambers are individually communicated with Oil galleries or conduits 65 and 66 formed in the rocker shaft 3. With this arrangement the two high speed cam followers can be individually locked in place and arranged to cooperate with high speed cams having different profiles. By way of example, it is possible with the instant embodiment to arrange for the roller 14 to cooperate with a cam having a profile which produces a small lift and opens the valves for a time particularly suited to engine idling. One of the high speed cam followers can be adapted to follow a cam having a profile which is suited for high load/low engine speed operation, while the second follower be arranged to cooperate with a cam which is profiled for high load/high engine speed operation.

FIFTH EMBODIMENT

Figure 10:
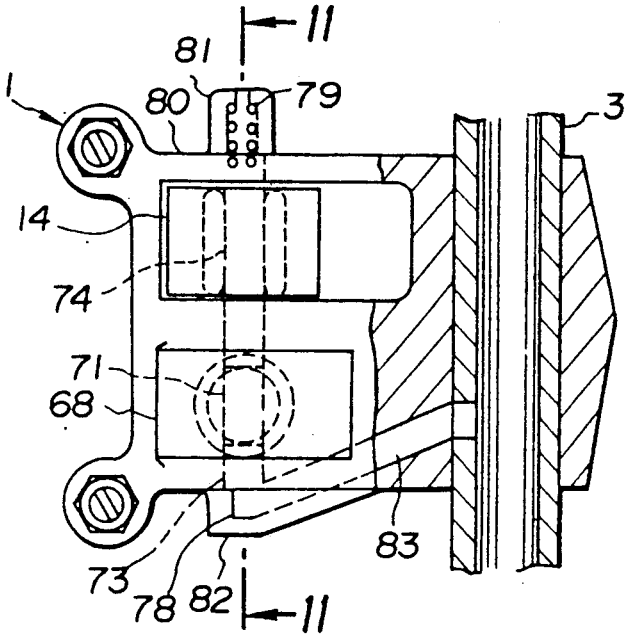
FIG. 10 is a plan view, partially in section, which shows a fifth embodiment of the present invention.
Figure 11:
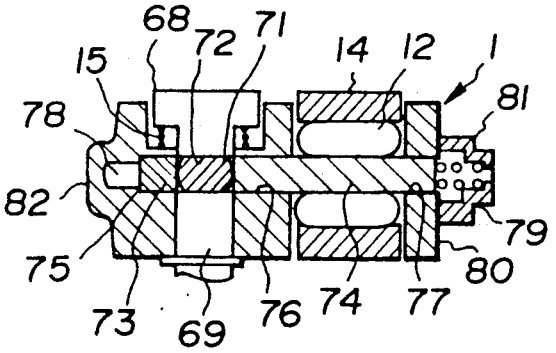
FIG. 11 is a sectional view of the fifth embodiment as taken along section line 10—10 of FIG. 10.

FIGS. 10 and 11 show a fifth embodiment of the present invention. This arrangement is somewhat similar to the first embodiment and differs in that one of the plungers (viz. plunger 74) also doubles as the support shaft of the roller 14; and the bores in which the plungers are disposed are formed so as to be essentially parallel with the rocker shaft. A return spring 79 is located at one end of the plunger/shaft 74 on which the roller 14 is supported by way of the needle bearings. A plunger 71 is reciprocatively received in a bore formed in the shaft which extends downwardly from rectangular head portion 68 on which the cam following surface is formed. A third plunger 73 is received in the third bore. One end of this plunger is exposed to a control chamber 78.

In this embodiment the control chamber 78 is formed in a extension 82 which projects laterally outward from one side of the rocker arm 1. A passage 83 provides fluid communication between the control chamber and a passage formed in the rocker shaft 3.

As the movement of the three plungers only occurs when both of the cam followers 14, 68 are in engagement with the base circles of the low and high speed cams, the load on the plunger/shaft 74 is relatively low and little frictional resistance the axial movement of the same occurs. Accordingly, this embodiment also exhibits very good response to the application of pressure in the control chamber 78.

The return spring 79 is received in a cap-like member 81 which is threadedly or fixedly received on a boss formed on the side of the rocker arm 1. This allows for the plungers to be inserted into place and the cap and spring set in place. In addition to facilitating assembly, this construction also exhibits a reduced number of parts.

SIXTH EMBODIMENT

Figure 12:
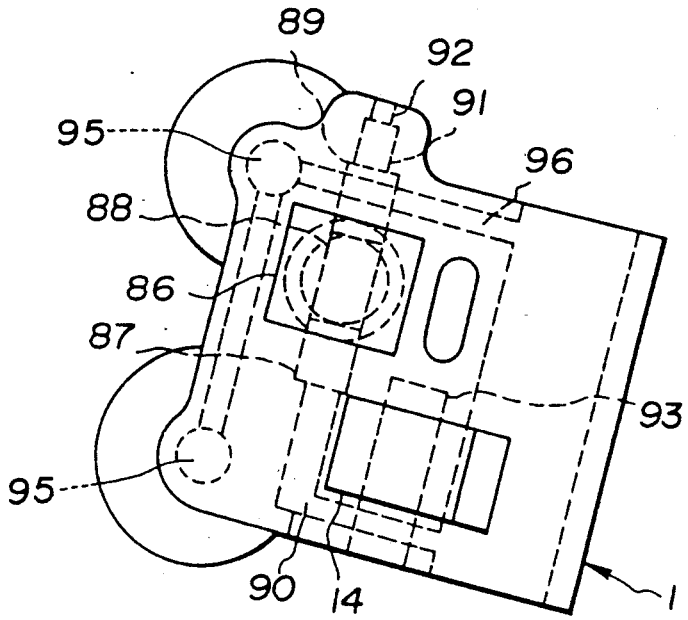
FIGS. 12 and 13 are plan and side elevational views of a sixth embodiment.
Figure 13:
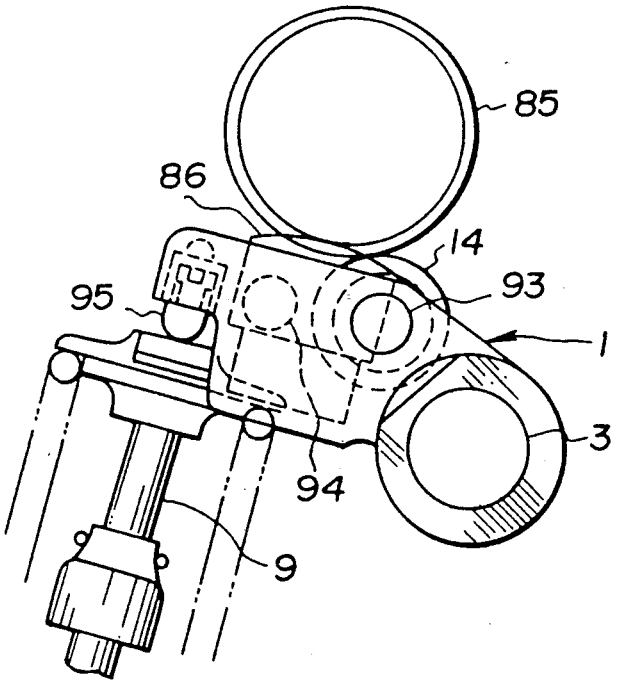
Figure 14:
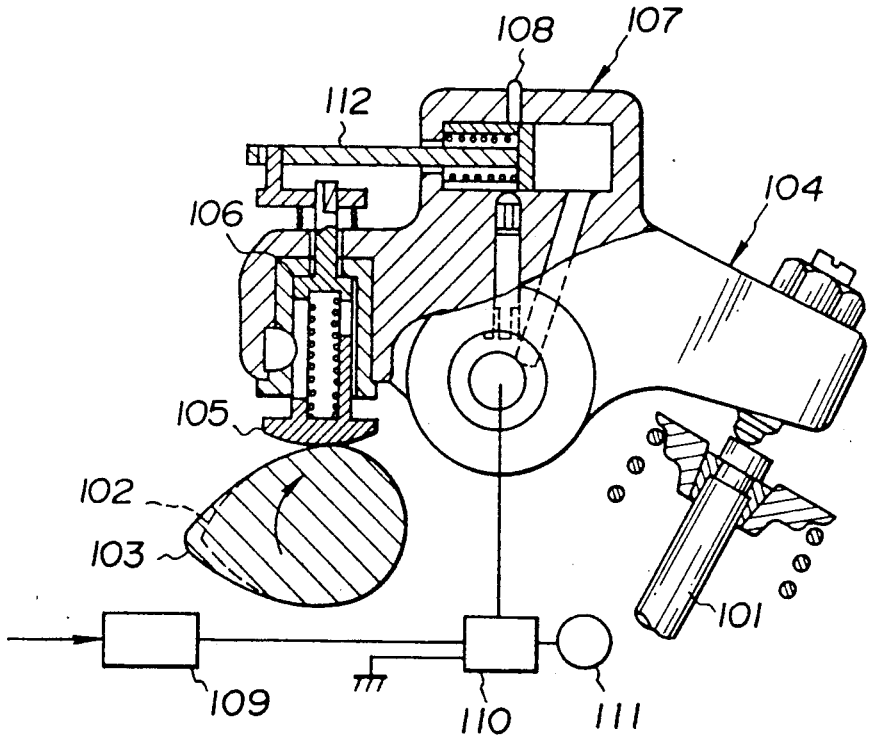
FIG. 14 shows the prior art arrangement discussed in the opening paragraphs of the instant disclosure.

FIGS. 12 and 13 show a sixth embodiment of present invention. In this arrangement the high speed cam follower arrangement 86 is located so as to be in the shadow of the cam shaft 85 while the roller 14 which acts as the low speed cam follower is located slightly rear of the cam shaft and closer to the rocker shaft 3. The roller 14 is supported on a shaft 93 which is force fitted into a bore formed in the rocker arm 1. The high speed cam follower arrangement has a rectangular headed mushroom-like configuration similar to embodiment shown in FIGS. 10 and 11.

In this embodiment the three plungers are arranged in bores 87, 88, 89 which are essentially parallel with the rocker shaft 3. The return spring in this instance is housed in a vented recess formed in cap-like member on one side of the rocker arm 1.

Hydraulic lash adjusters 95 are provided front corners of the rocker arm 1 and arranged to engage the tops of the valves 9. A passage 96 which originates at the bore in which the rocker shaft is received, extends forward to the first lash adjuster and then extends across the front edge of the rocker arm to the second device. The passage 96 is arranged to pass under the plunger bore 89.

A second passage 90 leads from the rocker shaft bore, under the shaft 93 and then across in front of the recess in which the roller is disposed to the control chamber defined at one end of the plunger bore 87. Although not shown the passage structures formed in the rocker shaft 3 are such as to enable individual pressures to be supplied to the passages 90 and 96.

What is claimed is:

1. In a valve train for an internal combustion engine having a cylinder head, a poppet valve which is associated with said cylinder head and a rocker shaft which is supported on said cylinder head:

a rocker arm, said first rocker arm being pivotally mounted on the rocker shaft, said rocker arm having a portion adapted to engage said poppet valve:

a first cam follower supported on said rocker arm, said first cam follower being arranged to engage a first cam provided on a cam shaft;

a second cam follower which is reciprocatively mounted on said rocker arm, said second cam follower comprising:

resilient means for biasing said second cam follower into contact with a second cam provided on the cam shaft;

means defining a first bore in said second cam follower in which a first plunger is reciprocatively disposed;

means defining a second bore in said rocker arm, said second bore being arranged to align with said first bore under a predetermined rocker arm operation; and hydraulically controlled means for causing said plunger to slide axially in said first bore and for causing a portion of said plunger to project into said second bore.

2. A valve train as claimed in claim 1 wherein said second cam follower has a head portion which engages said second cam and a shaft portion which is reciprocatively received in a third bore formed in said rocker arm and wherein said resilient means comprises a lost motion spring which is disposed between the rocker arm and said head portion.

3. A valve train as claimed in claim 1 wherein said first and second bores are arranged to extend radially along said rocker arm.

4. A valve train as claimed in claim 1 wherein said first and second bores are arranged to extend essentially parallel with the rocker shaft.

5. A valve train as claimed in claim 1 wherein said rocker arm is pivotally supported on said rocker shaft proximate one end of said rocker arm.

6. A valve train as claimed in claim 1 further comprising a hydraulic lash adjuster, said lash adjuster being arranged to engage the top Of the poppet valve.

7. A valve train as claimed in claim 1 wherein said hydraulically controlled means comprises:

a second plunger reciprocatively disposed in said second bore;

a return spring disposed in said second bore and arranged to bias said second plunger toward the first plunger; and means defining a third bore in said rocker arm in which a third plunger is disposed, said third bore being coaxially aligned with said second bore, said third plunger defining a control chamber in said third bore into which hydraulic fluid under pressure can be selectively supplied.

8. A valve train as claimed in claim 7 wherein said first cam follower comprises a roller, said roller being rotatably supported on a portion of second plunger.

9. A valve train as claimed in claim 1 wherein said first and second bores align when said first and second cam followers are engaging the base circles of the first and second cams.

10. A valve train as claimed in claim 7 wherein said first, second and third bores align when said first and second cam followers are engaging the base circles of the first and second cams.

11. A valve train as claimed in claim 7 where the first, second and third plungers are so dimensioned that when the pressure in said control chamber produces a bias which is lower than the bias of the return spring the first, second and third plungers are maintained in the first, second and third bores and the second cam follower is permitted to reciprocate with respect to the rocker arm.

* * * * *